US005356129A

United States Patent [19]

Godlewski

[11] Patent Number: 5,356,129

[45] Date of Patent: Oct. 18, 1994

[54] PRESS FEEDING APPARATUS

[76] Inventor: Edward S. Godlewski, 129 S. Spruce, Wooddale, Ill. 60191

[21] Appl. No.: 31,060

[22] Filed: Mar. 29, 1993

Related U.S. Application Data

[63] Continuation of Ser. No. 695,565, May 3, 1991, abandoned.

[51] Int. Cl.[5] ..... B65H 29/66

[52] U.S. Cl. ..... 271/212; 271/3.1; 271/151; 271/152

[58] Field of Search ..... 198/860.1, 860.2; 271/31, 151, 152, 212, 3.1; 414/788.8, 795.8, 797

[56] References Cited

U.S. PATENT DOCUMENTS

| | | | |
|---|---|---|---|
| 1,819,841 | 8/1931 | Hudson | 271/212 X |
| 3,692,304 | 9/1972 | de Ridder | 271/212 X |
| 3,900,115 | 8/1975 | Kumagai | 414/795.8 X |
| 4,071,234 | 1/1978 | Schick | 271/107 X |
| 4,369,959 | 1/1983 | Hornbuckle | 271/212 X |
| 4,478,400 | 10/1984 | Commers | 271/212 X |
| 4,666,140 | 5/1987 | Godlewski | 271/151 X |
| 4,762,314 | 8/1988 | Harada | 271/212 X |
| 4,786,040 | 11/1988 | Thomsen | 271/212 X |

*Primary Examiner*—Michael S. Huppert
*Assistant Examiner*—Janice Krizek
*Attorney, Agent, or Firm*—Francis C. Kowalik; John J. Kowalik

[57] ABSTRACT

A conveying mechanism for a press having sucker fingers which lift horizontally positioned items. The mechanism having two conveying sections for supporting imbricately arranged items, the first conveying section delivering to the second and the second section having components which rearrange the items into a vertical stack and lift it by wedging the items one under the other to a position where the fingers pick off the uppermost item of the stack.

9 Claims, 5 Drawing Sheets

FIG. 3
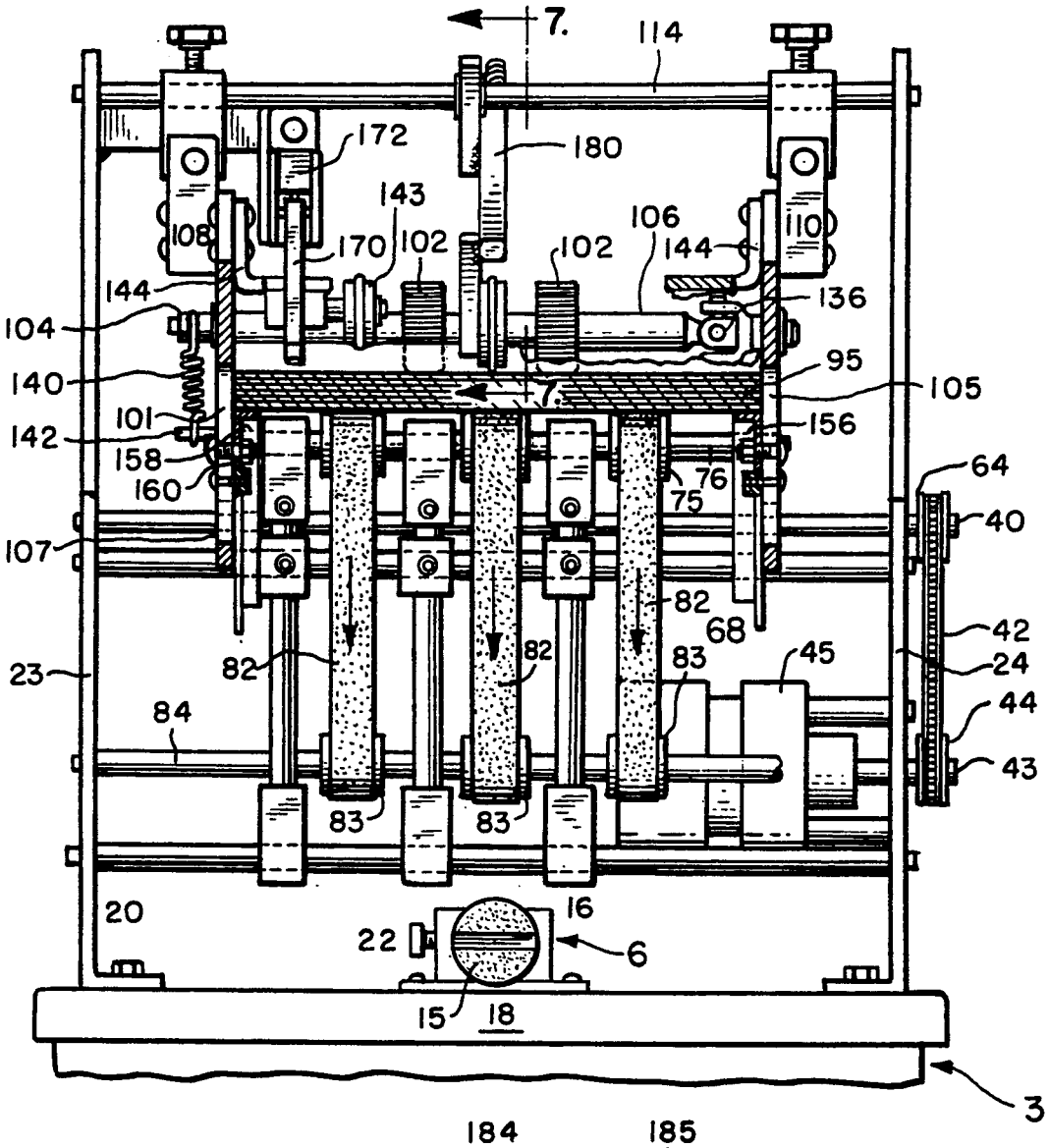
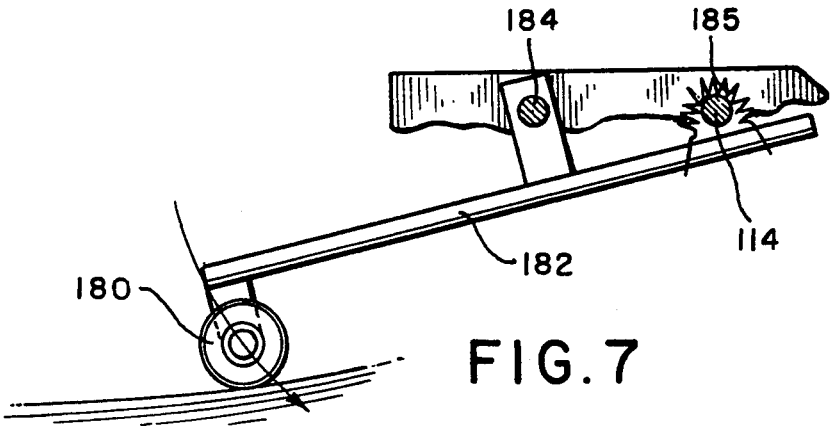
FIG. 7

PRESS FEEDING APPARATUS

This is a continuation of co-pending application Ser. No. 07/695,565 filed May 3, 1991, abandoned.

BACKGROUND OF THE INVENTION

This invention relates to apparatus of feeding flat items such as envelopes, sheets of paper or folded bags and the like to a press having vacuum fingers for lifting each item and delivering it to a press.

Various feeders have been developed and are being marketed which provide a conveyor leading into a retard system where the items are metered and peeled off the top of a stack and delivered through the retard assembly individually to a position beneath the sucker fingers of the press whereat the fingers are lowered against the item and in timed sequence with the press feeders, the fingers lift the item and deliver the same to the press mechanism which grasps an edge of the item and wraps it about a driver which feeds it into the printer. This type of feeder is not only expensive but also invariably requires an operator to adjust various components of the feeder which must be accurately synchronized to obtain a proper feed in timed sequence with the pick up of the press. Particularly for an inexperienced operator this becomes frustrating. The previous designs require the attention of a seasoned operator to set up the equipment. Various attempts have been made to simplify the apparatus to obtain a low cost feeder.

SUMMARY OF THE INVENTION

An object of this invention is to arrange a series of components in a manner requiring minimal adjustment and in which the components are static and wherein the presentation of items individually in sequence is accomplished by the items themselves wedging each other into place.

A further object is to provide a feeder having horizontally arranged components comprising movable belts supporting the items which are imbricately arranged and which feed directly onto the upper runs of a set of elevator belts which continuously deliver the imbricated items en masse against a vertical guide whereat the items are caused to slide one under the other within a lower portion of a magazine and thus are elevated to the upper end of the magazine so that the uppermost item positions beneath the vacuum fingers of a press and are lifted thereby and transported to the press.

Another object is to provide a novel switch arrangement having an operating arm which rests upon the uppermost item and is lifted by the items as they are wedged therebeneath raising the arm and disconnecting the switch and thereby a motor which drives all of the components, the switch for starting and stopping the apparatus being activated upon the switch arm dropping sufficiently as the uppermost items are depleted so as to close the switch and cause the apparatus to lift more items which then opens the switch. This action is continuously repeated so that the main conveyor belts and the lift belts are incrementally moved to meet the magazine requirements.

A further object is to provide a feeding mechanism which provides a smooth flow of the items in a continuous stream.

The invention contemplates a mechanism for changing direction of the items by the items themselves serving to lift each other by moving from a virtually horizontal to a vertical position.

This invention comprehends a novel conveyor for a press which has sucker fingers adapted to lift and discharge into a press flat items presented horizontally therebeneath, said conveyor having an elongated section supporting end moving imbricately arranged items toward one end into a transition section which repositions the items horizontally and forms a vertical stack and lifts the stack to the sucker fingers of the press.

The invention contemplates in its broad aspects a novel conveyor system in which items are positioned shingle fashion in a horizontal arrangement and which are rearranged into a vertical stack positioning each item to a vacuum lift which discharges the items individually from the top of the stack.

Another object is to provide a transition mechanism which provides an upright wedging surface engageable with the leading edges of the imbricately arranged items which are forcibly delivered against the wedging surface and functions to lift the lower edges of the items into a horizontal position in alignment with the upper edges and form a vertical stack with a flat horizontal upper surface. The invention contemplates a novel feeder in which a generally horizontal conveyor supports imbricately arranged items feeding toward one end and in which the lower edges of these items are engaged by belts which are wax polished to reduce the friction coefficient so that at the delivery end of the horizontal conveyor the belts slide under the items so as to prevent piling up before the cut off switch functions to cut off power to the driving mechanism.

These and other objects of the invention will become apparent from the specification and drawings, wherein:

FIG. 3 is a cross-sectional view taken substantially on line 3—3 of FIG. 1 with parts removed for clarity;

FIG. 7 is a sectional view taken on line 7—7 of FIG. 3;

DESCRIPTION OF THE INVENTION

Figures 1, 2:
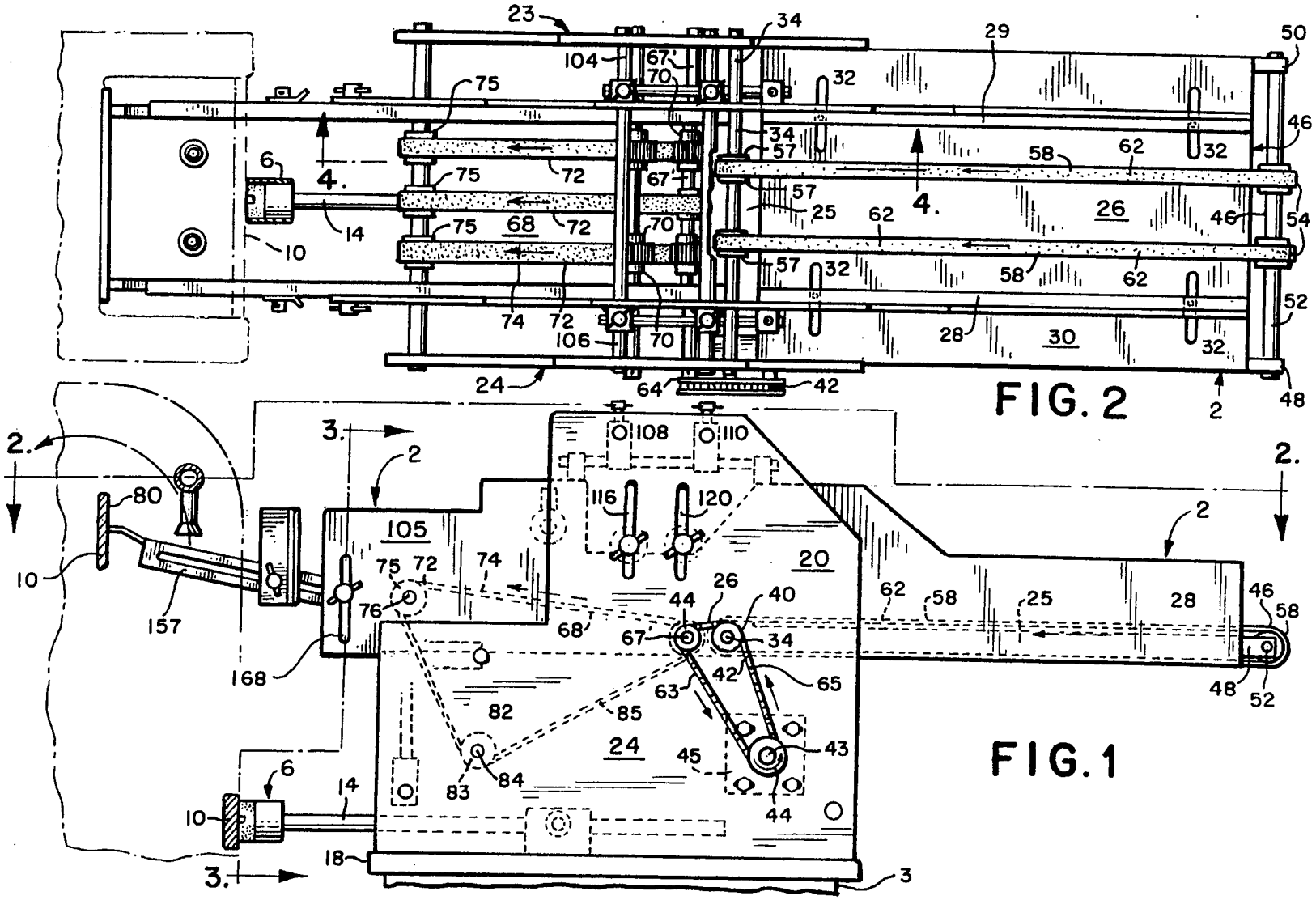
FIG. 1 is a side elevational view of the conveyor.
FIG. 2 is a top plan view thereof.
Figure 4:
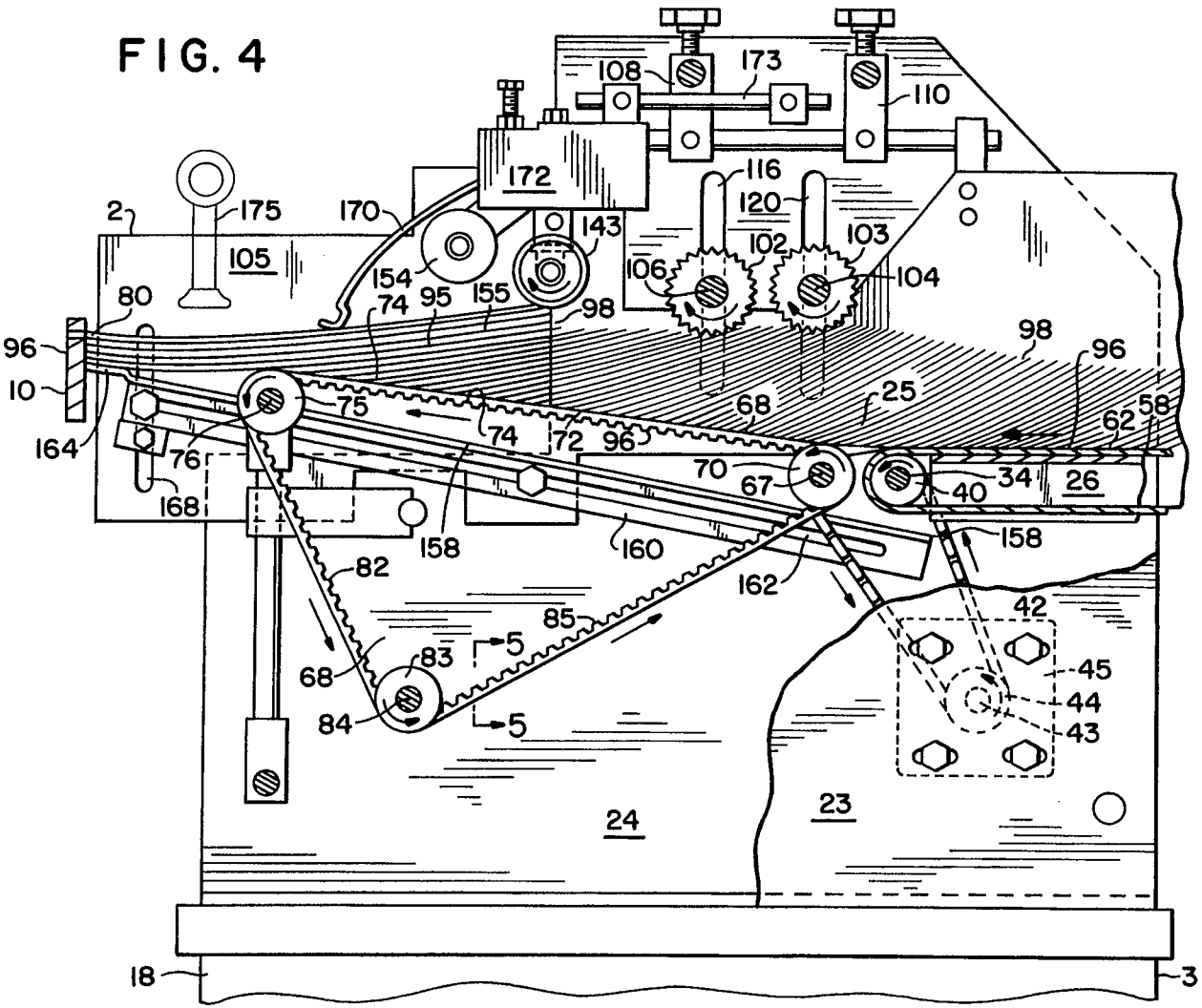
FIG. 4 is a longitudinal vertical section taken substantially on line 4—4 of FIG. 2.

The conveying apparatus generally designated 2 comprises a base support 3 which may be in the form of a wheeled cabinet partially shown in FIGS. 1 and 4. It supports the conveying apparatus 2 and adjustably carries a magnet 6 at its distal end which is adapted to engage and hold onto an opposing end wall 10 made of a metal such as steel or cast iron frame of a press to hold the apparatus 2 in operative position to the press.

The adjustment of the magnet toward and away from the press as required by different size items comprises a rod 14 extending longitudinally of the apparatus. The rod 14 extends through an aperture 15 in a mounting block 16 which is secured to the bottom wall 18 of a frame 20 of the apparatus. A set screw 22 is employed in usual manner to hold the rod in adjusted position to the block.

The frame 20 has a pair of vertical laterally spaced side walls 23, 24 which flank the delivery end 25 of a generally horizontally positioned infeed conveyor 26.

Conveyor 26 has a pair of upright guiding side walls 28, 29 and a bottom wall 30 connected at its lateral edges to the walls 28, 29 by laterally adjustable slot and bolt and nut assemblies 32, 32.

The delivery or discharge end of the infeed conveyor is pivotally supported via its side walls on drive shaft 34 which extends through bearing-lined apertures in the side walls 23, 24 of the frame.

Shaft 34 is keyed to a drive sprocket 40 which is driven by a chain 42. The chain extends about a sprocket 44 which is connected to a drive shaft 43 of an electric motor 45 (FIG. 3) mounted on a side wall of the frame 20.

The infeed conveyor has its distal or entry end 46 provided with lugs 48, 50 as extensions from the rear end of the bottom wall structure 30 and mount the ends of a shaft 52.

Wheels or pulleys 54, are rotatably mounted on shaft 52 and conveyor belts 58, are trained about respective pulleys or wheels 57 on shaft 34 as shown clearly in FIG. 2.

Each belt has a top run 62 which extends longitudinally of the infeed conveyor.

The motor driven chain 42 has a portion which extends over a sprocket 44 and joins a return length 63 which leads to the sprocket on the motor shaft and extends to the advance run 65 of the chain. The chain is driven in the direction of the arrows shown in FIG. 1.

The chain drives a horizontal shaft 67' which is part of a transition and ascending section generally designated 68. The shaft 67' is journalled in bearing-lined openings in the side walls 23, 24 of the main frame or support.

The shaft 67' is connected to axially separated wheels or pulleys 70, 70, 70 about which there are wrapped ascending wedge belts 72, 72, 72. Each belt 72 is trained about a separate wheel 70 and provides an upper run 74 extending between the wheels 70 and the pulleys on wheels 75, the latter being rotatable on a shaft 76 mounted at its ends on the side walls 23, 24 of the main frame of the apparatus.

The shaft 76 is elevated with respect to drive shaft 67' and the top runs 74 of the transition belts extend diagonally upwardly toward a vertical stop or wedge surface 80 of the press and thus the belts 72 form an obtuse angle with respect to the surface 80.

The belts 72 each have a return length 82 and each is trained about one of the three idler rollers 83 rotatable on shaft 84 which is secured at its ends to the side walls 23, 24 of the main frame. The return run of each belt 72 has a length 85 which continues and joins the top run of a respective belt 72.

The wheels 70 and adjacent ends of the belts 72 are spaced close to the discharge end of the infeed conveyor as best seen in FIG. 4.

Each belt 72 is a laminated structure having an inner band 86 which is made of conventional belt material such as rubberized cotton or the like. Belt 72 has an outer band 88 which is bonded on its inner side 89 to the external side 90 of the inner band portion and is made of a polyurethane and has a higher coefficient of friction on its smooth outer item-engaging surface 94, than the belts of the infeed conveyor which have a polished or slick smooth surface so that when excessive delivery is made of the stack of items 95 which are imbricately arranged and continuous, the belts 5 8 slide under the items until the items in the transition section are sufficiently depleted to prevent jamming.

The stock items 95 present leading edges 96 which bear against the belts of the infeed conveyor and the transition conveyor. Items 95 have trailing upper edges 98 which are positioned rearwardly of the respective lower edges.

As the items are being forced against the vertical stop surface each item is wedged upwardly by the vertical vector resulting by the components of the force urging the items against the vertical guide surface 80.

It will be noted that the upper edges of the items are engaged by a plurality of serrated polyurethane rollers 102, 103. These rollers are mounted on vertically floating shafts 104, 106. These shafts 104, 106 are movable vertically at one end in vertically elongated slots 116, 120 in plate 107.

It will be noted that the items 95 are guided at their side edges by vertical guide plates 105, 107 which are mounted on support hangers 108, 110 and are adjustable parallel to the flow of the items by slotted connections 112 to the respective hangers. The hangers are adjustably mounted on a rod 114 which extends between the side panels 23, 24 and is secured thereto.

The guide plate 105 has vertical slots 116 and 120 through which extend the ends 122, 124 of shafts 104, 106 which rotatably mount the pair of hold-down roller assemblies 102, 103. The shafts 104, 106 have universal joints 136 at one of their ends thus accommodating vertical movements of the respective roller assemblies 102, 103. Only one universal joint in a selected adjusted position is shown in FIG. 3. The universal joints are secured to the side plate 105. However, along slots 116, 120, both shafts 104, 106 have universal joint connections to plate 107.

The other ends of the shafts 104, 106 extend through vertical slots 116, 120 in the side wall 105 and each are biased downwardly by tension springs 140 which are hooked at their upper ends to the respective shaft 104, 106 and at their lower ends are hooked onto a pin 142 projecting from the guide wall 105 as best seen in FIG. 3.

Roller assemblies 102, 103 on shafts 104, 106 engage the upper trailing edges 98 of the items as seen in FIG. 4 and pursuant to the wedging effect developed at the transition stage cause the items to be held at selected pressure against the upper top sides 74 of the belts 72 for controlling the flow of the items 95.

Figure 6:
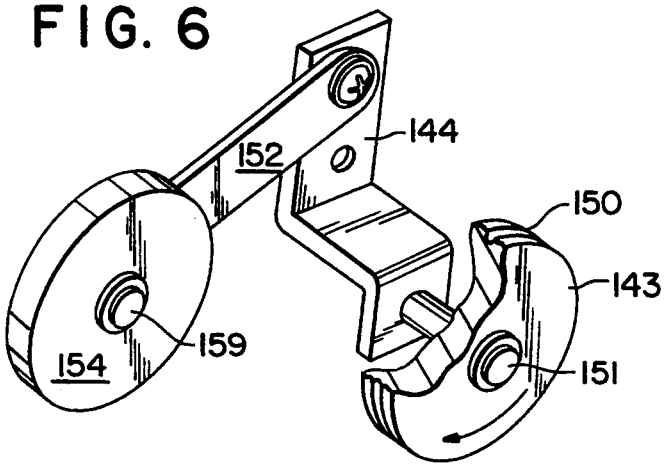
FIG. 6 is a perspective view of the lifter.
Figure 9:
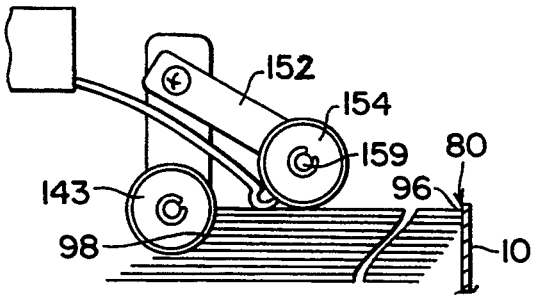
FIG. 9 is an enlarged portion of the stop and lift wheel assembly.
Figure 5:
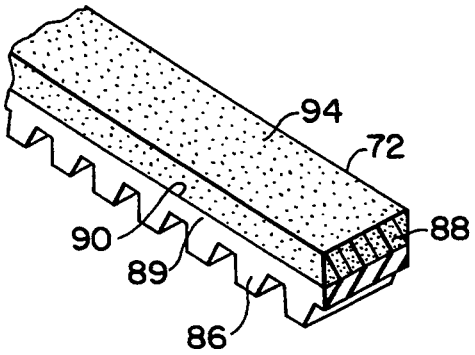
FIG. 5 is an enlarged cross-section of the lifting belt.
Figure 10:
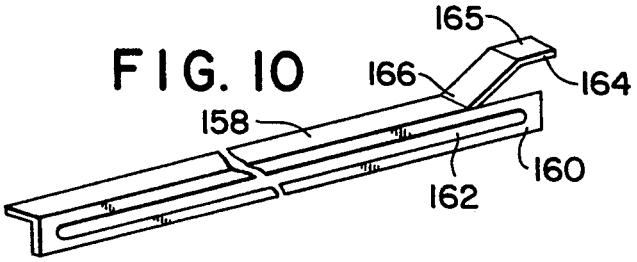
FIG. 10 is an enlarged portion of the discharge end of each guide rail.

The items 95 as they move beyond the hold-down rollers 102, 103 assume a generally horizontal position as seen in FIG. 4, the leading ends are positioned to engage surface 80 and slide upwardly along side rails 156, 157 as hereinafter disclosed. The trailing edges of the items are engaged adjacent their lateral edges, as they move upwardly, by a rotary lift wheel 143 which is adjustably mounted on a bracket 144 (as seen in FIG. 6). Each bracket is secured to the respective guide plate 105 or 107. The lift wheels 143 rotate about horizontal axes and engage the trailing edges 98 of the items while the leading edges 96 are engaged with the surface 80.

The wheels 143 as best seen in FIG. 6 are peripherally grooved and fitted in the grooves with a rubber o-ring 150, and rotate in the direction of the arrows shown thereon as the items ascend.

Each bracket 144 also supports and is connected to one end of an arm 152 which at its distal end supports a rotary stop wheel 154 rotatable about a horizontal shaft 159 extending transversely of the direction of flow of the conveyed items.

The stop wheels 154 limit the upward movement of the vertically arranged section 155 of the stack of items.

Figure 8:
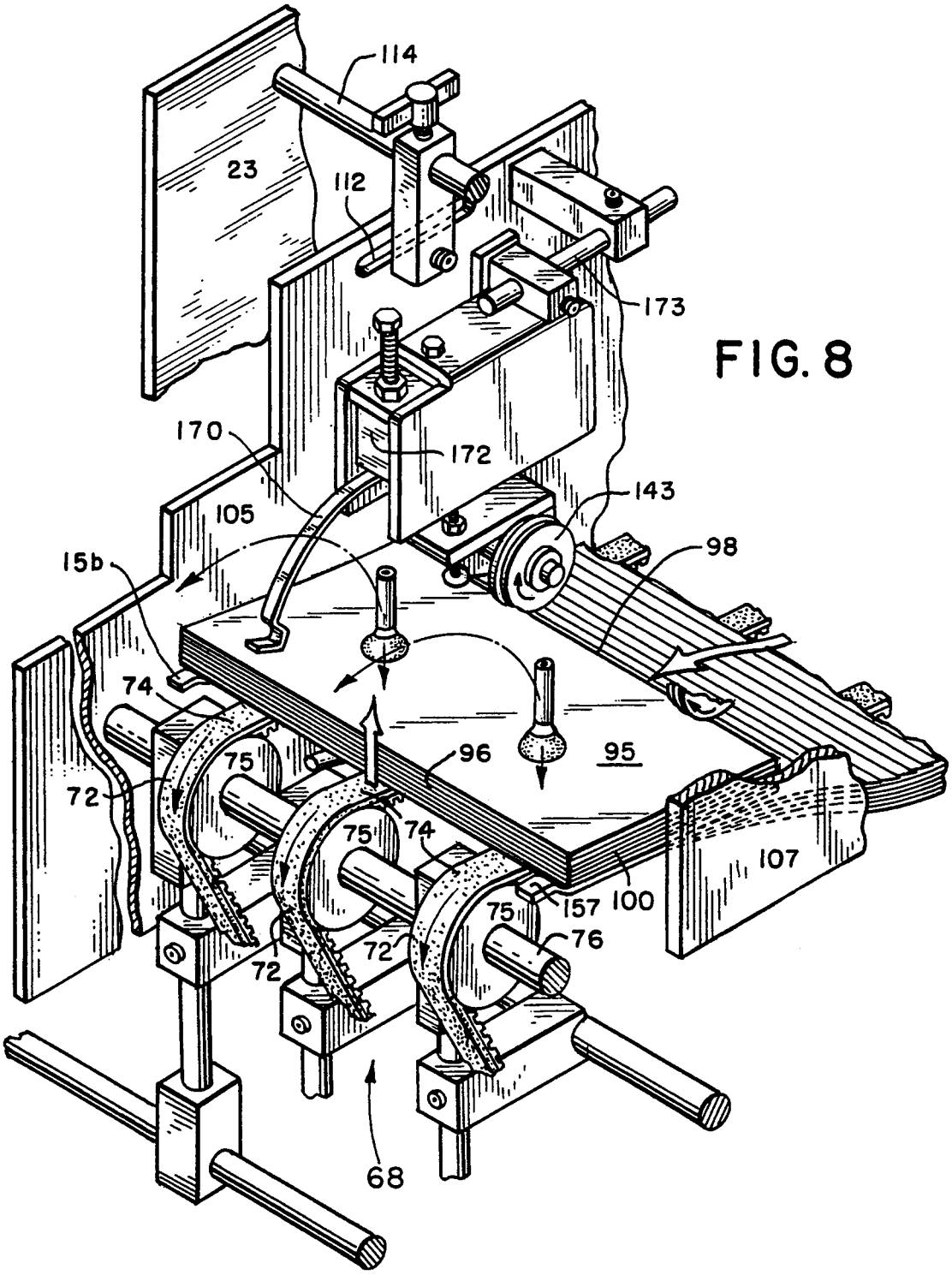
FIG. 8 is a perspective view of the lifter assembly.

As best seen in FIG. 4, the leading end of the stack when it reaches a position beyond the discharge end of the lift belts 72, is guided on guide rails 156, 157 (FIGS. 3 and 8) and are attached to the guide plates 105, 107. The rails are L-shaped in cross-section and have a top flange 158 and a vertical flange 160. Flange 160 is provided with longitudinal slots 162 for lengthwise adjustment of the rails necessitated by different lengths of the items 95.

The discharge end portion 164 of the rails are upset and provide a step 165 joined by a riser 166 to the adjacent end of the flange 158 of the related guide member.

The step 165 is essentially horizontal to facilitate the leading edges of the stack items to engage the guide surface 80 essentially normal thereto.

As shown in FIG. 4 the leading end of each guide rail may be lifted or lowered by adjusting it along the vertical slot 168 in the associated guide wall 105 or 107.

When the stack reaches a height limited by the stops, a switch arm 170 of switch 172 is lifted to a disconnect position and the motor is stopped until a top increment of items is depleted and the arm 170 drops to the position shown in FIG. 4 which causes the switch 172 to close and complete a circuit from the switch to the motor and thus turning it on.

The items in the vertical stack are horizontally positioned and flat and have their leading edges positioned against press member 10 and the wheels 143 and the trailing portions of the items are brought to bear against the underside edges of the stop wheels which tend to urge the items in the vertical stack forwardly toward stop 10 as the vertical stack rises.

The sucker fingers 175 grasp each top item and move it initially upwardly. As each item is being lifted it slightly bends in the area of the stop wheels and as the item is pulled upwardly cause the stop wheels to rotate thus releasing each top item from under the stop wheel.

The switch is mounted through a system of rods and mounting blocks generally designated 173 to the guide wall 105 and may be positioned forwardly or rearwardly relating to the slot 112. Any other suitable mounting may be used.

In operation the stock items are hand delivered to the intake conveyor and imbricately arranged thereon as seen in FIG. 4. The items are discharged from the delivery end of the intake conveyor onto the lift belts 72 of the transition section and are urged diagonally upwardly toward the guide 10 and engage the leading edges of the items against the vertical surface 80. The items each wedge between the item thereabove and the one therebelow thus lifting that portion of the stack upwardly.

The trailing ends of the upwardly moving stacked portion are positioned to extend between the lift wheels 143 and the surface 80 and as this portion of the stock rises it lifts the switch arm until the magazine is filled to capacity. The switch arm opens the switch causing the intake conveyor and the lift belts to stop. The press sucker fingers in the meantime are continuously depleting the stack and when a predetermined number is exhausted, the arm will have dropped sufficiently as seen in FIG. 4 causing the switch to close and the intake conveyor and lift conveyor sections to operate and supply additional items to the vertical stack portion.

As the items are moving by advance of the belts 72, a hold-down roller 180 holds the items with light pressure against belts 72. This roller also acts to downwardly bias the items allowing the items to both be cantilevered over the end of the belts 72 and provide a curved backside of the items to assist in rotation of the items from the horizontal stack to the vertical stack.

Roller 180 is mounted on a horizontal transverse axis to one end of a rod 182 which is pivoted intermediate its ends from support rod 184 mounted between walls 23, 24. The roller 180 is spring-biased downwardly against the items moving therebeneath by a spring 185 which is arranged to react between a stationary rod 114 and the arm 182.

The drawings illustrate the rails in withdrawn position. If the items are long, the rails are extended. The magnet holding device is also extended and locked. Under these circumstances as the items leave the belts 72 and drape over the discharge ends of the belts 72, the items discharged from belts 72 enter upon the guide rails along their lateral edges and are intermittently advanced toward the surface 80 by the items therebeneath still on the belts 72 and the action and movements of items 95 as hereinbefore described repeats.

What is claimed is:

1. An apparatus for feeding stock items to a press having vacuum pick-up fingers comprising:

a stack holding area including a vertical guide surface, a conveyor means inclined with respect to a horizontal plane and guide means contiguous to the vertical guide surface;

a substantially horizontally disposed conveyor means;

lift means; and stop means;

whereby stock items are transported in an imbricated fashion on the horizontal conveyor means, the horizontal conveyor means feeds the imbricated stock items onto the inclined conveyor means, the inclined conveyor means forces leading edges of the stock items onto the guide means, and against the vertical guide surface, the lift means engage the trailing edges of the stock items on the inclined conveyor means and the stop means engage the top surface of a topmost stock item conveyed on the inclined conveyor means, the coaction of the inclined conveyor means, the lift means and the stop means effecting the reorientation of the imbricated stock items into a vertical stack of stock items abutting the vertical guide surface.

2. The apparatus according to claim 1, and means mounting said lift means and said stop means for movement about a common axis extending generally parallel to said vertical guide surface.

3. The apparatus according to claim 1 and means for interconnecting said lift means and said stop means for cooperative movement about a common axis.

4. The apparatus according to claim 1 and means floatingly supporting a hold-down roller assembly for contacting said trailing edges of said stock items.

5. The apparatus according to claim 4 and said apparatus comprising a frame and universal joints connecting said means floatingly supporting said hold-down roller assembly to said frame.

6. The apparatus according to claim 1 and switch means operative to control replenishment of said vertical stack.

7. The apparatus according to claim 1 wherein said guide means comprise a longitudinal flange portion and an inclined discharge end portion.

8. The apparatus according to claim 1 wherein said lift means comprise an edge composed of an elastomeric material.

9. The apparatus according to claim 1 and said inclined and horizontally disposed conveyor means comprising endless belt means frictionally engageable with said stock items.

* * * * *